US010892589B2

(12) United States Patent
Huber et al.

(10) Patent No.: US 10,892,589 B2
(45) Date of Patent: Jan. 12, 2021

(54) METHOD FOR PRODUCING A PLUG CONNECTOR, METHOD FOR AMPLIFYING A PLUG CONNECTOR AND DEVICE

(71) Applicant: Continental Teves AG & Co. oHG, Frankfurt (DE)

(72) Inventors: Dietmar Huber, Rödermark (DE); Svenja Raukopf, Gemünden Felda-Hainbach (DE); Jakob Schillinger, Gaimersheim (DE)

(73) Assignee: CONTINENTAL TEVES AG & CO. OHG, Frankfurt (DE)

( * ) Notice: Subject to any disclaimer, the term of this patent is extended or adjusted under 35 U.S.C. 154(b) by 336 days.

(21) Appl. No.: 15/898,636

(22) Filed: Feb. 18, 2018

(65) Prior Publication Data

US 2018/0175573 A1 Jun. 21, 2018

Related U.S. Application Data

(63) Continuation of application No. PCT/EP2016/068566, filed on Aug. 3, 2016.

(30) Foreign Application Priority Data

Aug. 25, 2015 (DE) ..... 10 2015 216 205

(51) Int. Cl.
*H01R 43/02* (2006.01)
*H01R 4/02* (2006.01)
*H01R 13/533* (2006.01)

(52) U.S. Cl.
CPC ..... *H01R 43/0221* (2013.01); *H01R 4/021* (2013.01); *H01R 4/029* (2013.01); *H01R 13/533* (2013.01); *H01R 2201/26* (2013.01)

(58) Field of Classification Search
CPC .... H01R 43/0221; H01R 43/02; H01R 4/021; H01R 4/029; H01R 4/02; H01R 4/625; H01R 13/533; H01R 13/6461; H01R 13/6474; H01R 2201/26; H01R 2201/12; H01R 24/64; B23C 26/20; A61N 1/056; Y10T 29/49195; Y10T 29/49201; Y10T 29/49204; Y10T 29/4922; Y10T 29/49169; Y10S 439/941
See application file for complete search history.

(56) References Cited

U.S. PATENT DOCUMENTS

2011/0147080 A1* 6/2011 Slininger ..... H01R 4/625 174/84 R

FOREIGN PATENT DOCUMENTS

| | | | |
|---|---|---|---|
| DE | 19751487 | A1 | 6/1999 |
| DE | 10133731 | A1 | 1/2003 |
| DE | 102008040813 | A1 | 2/2010 |
| EP | 1278277 | A1 | 1/2003 |

OTHER PUBLICATIONS

International Search Report and Written Opinion dated Oct. 17, 2016 from corresponding International Patent Application No. PCT/EP2016/068566.
German Search Report dated Jun. 30, 2016 for corresponding German Patent Application No. 10 2015 216 205.

* cited by examiner

*Primary Examiner* — Shawntina T Fuqua

(57) ABSTRACT

A method for establishing a plug connection, and a method for strengthening a plug connection, wherein a connecting zone is welded with a laser beam which passes through a surrounding housing owing to transparency.

16 Claims, 3 Drawing Sheets

METHOD FOR PRODUCING A PLUG CONNECTOR, METHOD FOR AMPLIFYING A PLUG CONNECTOR AND DEVICE

CROSS REFERENCE TO RELATED APPLICATION

This application claims the benefit of International application No. PCT/EP2016/068566, filed Aug. 3, 2016, which claims the benefit of German patent application No. 10 2015 216 205.2, filed Aug. 25, 2015, each of which is hereby incorporated by reference.

TECHNICAL FIELD

The technical field relates to relates to a method for establishing a plug connection, to a method for strengthening a plug connection, and also to an apparatus which is produced using said method

BACKGROUND

During use, plug connections are frequently subject to loads such as, for example, vibrations, changes in temperature or other influences which can damage a connecting zone between two connections.

Up until now, solutions have been based, in particular, on conventional plug connections which are typically no longer accessible after they have been established and sheathed. For connection purposes, spliced, soldered, welded or adhesive connections, for example, are inserted into a region which has not yet been closed. In the latter variant, a connecting point is protected by a closure process, for example by potting, in particular in a separate step.

In the case of procedures according to the prior art, it has been found that the load-bearing ability is too low for numerous applications. In addition, an alternative connecting process or subsequent protection of the connecting point requires a complicated process sequence.

As such, it is desirable to present a method for establishing a plug connection, a method for strengthening a plug connection, and also an apparatus which is produced using said method, wherein an alternative connection, in particular a connection which is more reliable and/or easier to establish, is formed. In addition, other desirable features and characteristics will become apparent from the subsequent summary and detailed description, and the appended claims, taken in conjunction with the accompanying drawings and this background.

BRIEF SUMMARY

A method for establishing a plug connection, in one exemplary embodiment, includes combining a first terminal and a second terminal, so that they overlap in a connecting zone. The method also includes sheathing the connecting zone with a plastic material which is transparent in at least one wavelength range. The method further includes irradiating the connecting zone with a laser beam, the wavelength of said laser beam lying in the at least one wavelength range, for the purpose of carrying out laser beam welding.

A plug connection which is particularly reliable and long-lasting owing to the laser beam welding can be established by this method. Owing to the use of an at least partially transparent plastic material, the laser beam welding can be carried out when the connecting zone has already been sheathed. Therefore, separate steps are not required.

Also disclosed is a method for strengthening a plug connection, according to one exemplary embodiment, where the plug connection is formed from a first terminal and a second terminal which overlap in a connecting zone, and where the connecting zone is sheathed with a plastic material which is transparent in at least one wavelength range. The method includes irradiating the connecting zone with a laser beam, the wavelength of said laser beam lying in the wavelength range, for the purpose of carrying out laser beam welding.

In particular, a plug connection which has already been formed can be strengthened by this method, wherein the method of laser beam welding can advantageously likewise be employed.

In particular, a welding point which connects the first terminal to the second terminal can be formed by the laser beam welding. This welding point can absorb and retain forces which typically act on the plug connection, so that harmful influences do not occur.

In one exemplary embodiment, a plurality of welding points may be formed by the laser beam welding. In particular, two welding points may be formed, by the laser beam welding. Said welding points connect the first terminal to the second terminal.

Owing to the use of a plurality of welding points, the effect of the laser beam welding may be increased since the forces are introduced or transmitted at a plurality of points.

In one exemplary embodiment, the first terminal may be, in particular, a male terminal. The second terminal may be, in particular, a female terminal. Male and female terminals of this kind typically fit one in the other. The terminals may be designed, in particular, in a complementary manner in relation to one another.

In one exemplary embodiment, the first terminal and/or the second terminal may have a flat tongue-like structure. In particular, the first terminal and/or the second terminal may have a slide-on aid in this case. This makes it easier to join the two terminals.

According to one exemplary embodiment, the method may also include ascertaining an optimal focal point onto which the laser beam is then focused. In this way, it is possible to ascertain, before the laser beam welding, the point at which the laser beam welding is advantageously carried out. In particular, it is possible to ascertain the point at which there is a hollow space in the connecting zone. The optimal focal point is then preferably outside this hollow space since typically only relatively poor welding would be possible in the hollow space.

The method may further advantageously include checking the connecting zone, in particular the welding points which are formed. Therefore, welding points can be checked, so that any faults in the production of said welding points can be identified before a component which has been produced is delivered and a fault potentially occurs for the first time during use.

The ascertaining process and/or the checking process may be carried out, in particular, by an x-ray device. This has proven to be successful for typical applications.

The laser beam can be shone onto the connecting zone from circumferential directions. This permits a very small region in the connecting zone to be heated point by point, wherein excessive heating of surrounding material is avoided. The laser beam can also be split into a plurality of beam elements which are shone onto the connecting zone from different directions at the same time. This also permits the same effect, so that relevant development of heat occurs only at a specific point.

The laser beam may have, in particular, a wavelength of between 520 nm and 565 nm. This corresponds to a green range. A wavelength range of this kind has been found to be advantageous for typical applications.

The plastic material may be, for example, polybutylene terephthalate (PBT) or polyamide (PA). These plastics have advantageous properties for sheathing a connecting zone and also, at least in some embodiments, the desired transparency.

The first terminal and/or the second terminal may be formed from copper and/or from bronze. This allows good electrical conduction and the production of good and reliable welding points.

In one exemplary embodiment, an apparatus which has a plug connection is established by a method as described herein. In respect of the method, reference can be made to all of the embodiments and variants described herein. Explained advantages correspondingly apply. The apparatus may allow the advantages described with reference to the method to be realized in respect of the plug connection.

BRIEF DESCRIPTION OF THE DRAWINGS

Other advantages of the disclosed subject matter will be readily appreciated, as the same becomes better understood by reference to the following detailed description when considered in connection with the accompanying drawings wherein.

DETAILED DESCRIPTION

Figure 1A:
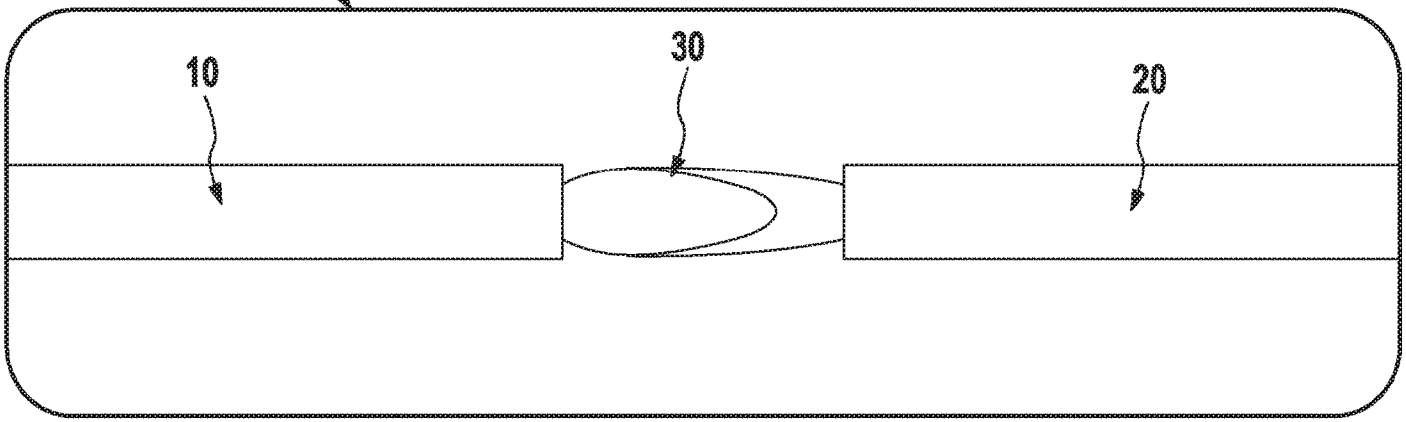
FIGS. 1*a* and 1*b* show a plug connection, before laser beam welding is carried out, with a housing.
Figure 1B:
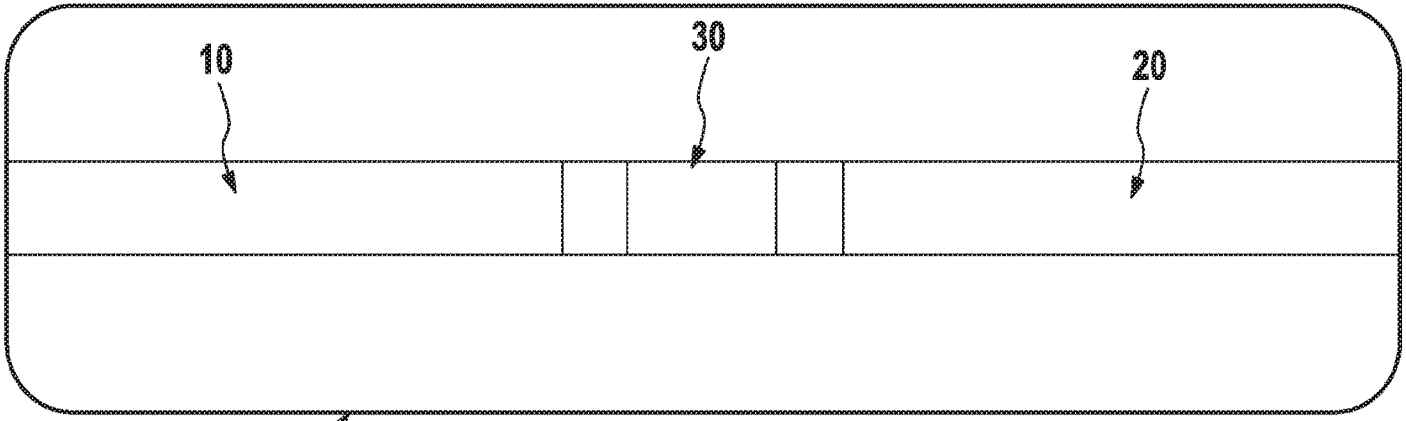

In one exemplary embodiment, FIGS. 1*a* and 1*b* show a plug connection which is formed from a first terminal 10 and a second terminal 20. FIG. 1*a* shows a side view, while FIG. 1*b* shows a plan view.

The two terminals 10, 20 overlap in a connecting zone 30. Therefore, said terminals are electrically contact-connected.

The connecting zone 30, together with adjoining parts of the terminals 10, 20, is surrounded by a housing 40. In one exemplary embodiment, the housing 40 is composed of a plastic material which is transparent in the green wavelength range.

The two terminals 10, 20 are mechanically connected to one another at the connecting zone 30 and also protected by the housing 40, but it has been found that, when subjected to loading over a relatively long period of time in situations such as, for example, in motor vehicles in which severe vibrations can occur, damage to the connecting zone 30 can occur on account of the associated forces. This can lead to contact between the terminals 10, 20 being adversely affected or even being lost.

Figure 2:
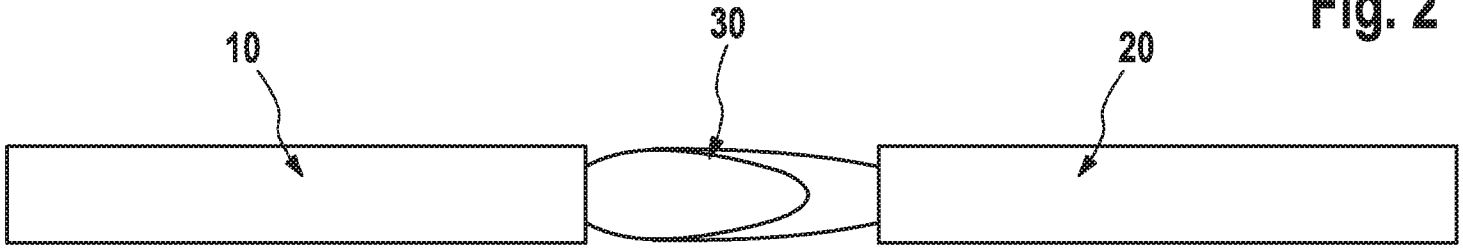
FIG. 2 shows the plug connection from FIG. 1 without a housing.

FIG. 2 shows the terminals 10, 20 with the connecting zone 30 of FIG. 1*a* formed therebetween, but without the housing 40.

Figure 3A:
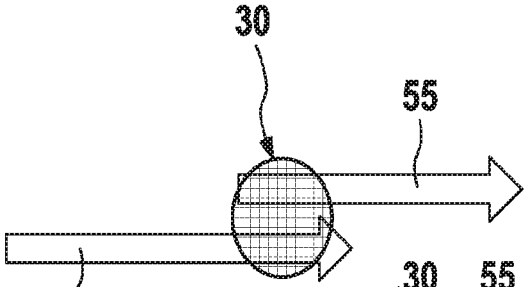
FIGS. 3*a*, 3*bc* and 3*c* show typical forces on the plug connection of FIG. 2.
Figure 3B:
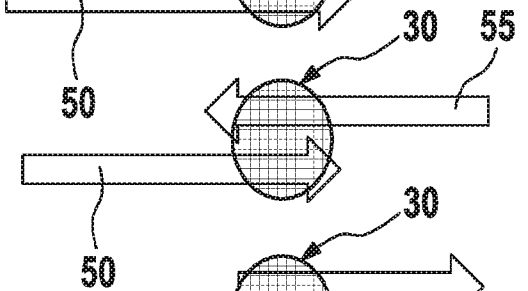
Figure 3C:
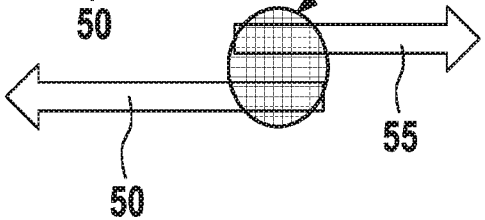

FIGS. 3*a*, 3*b*, and 3*c* show different force loads which can typically act on the connecting zone 30. FIG. 3*a* shows a first force 50 and a second force 55 which create loading in the same direction with different intensities. In FIGS. 3*b* and 3*c*, the two forces 50, 55 act in opposite directions, while in FIG. 3*b* the forces 50, 55 are directed toward one another, whereas they are directed away from one another in FIG. 3*c*.

The situations which are illustrated in FIGS. 3*a*, 3*b*, and 3*c* are typical loading situations which can act on the connecting zone 30 during use and which can lead to various instances of damage, particularly over a relatively long period of time.

Figure 4:
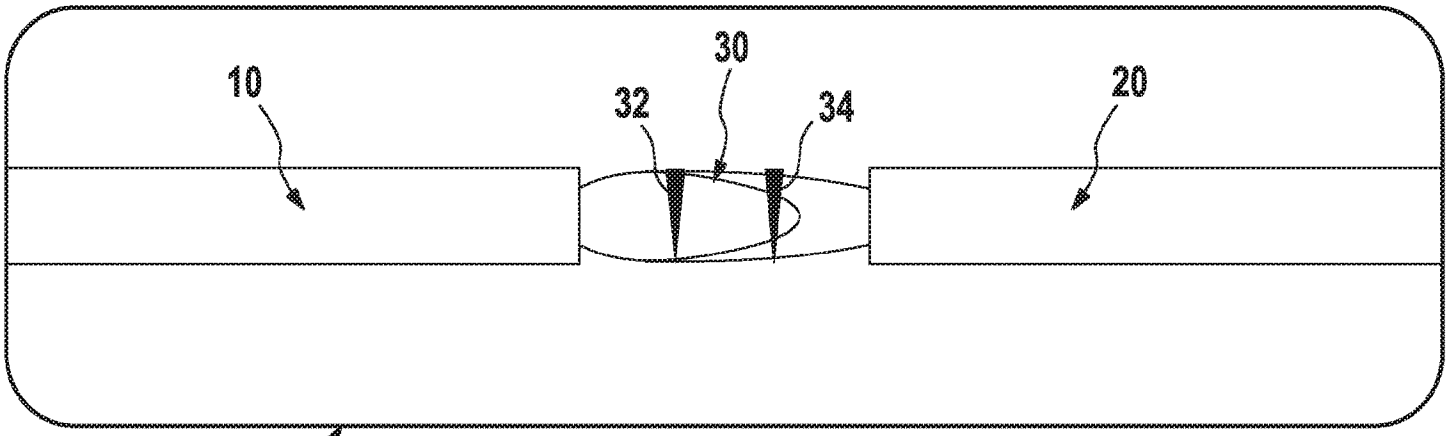
FIG. 4 shows the plug connection from FIGS. 1*a* and 1*b* after laser beam welding.

FIG. 4 shows the terminals 10, 20 after laser beam welding has been carried out. A first welding point 32 and a second welding point 34 have been formed in the connecting zone 30, which connects the first terminal 10 and the second terminal 20, owing to the laser beam welding. Therefore, the connection at the connecting zone 30 is significantly strengthened and a significantly higher resistance to force loads is achieved. In particular, it has been found that the resistance to vibrations and similar loads which typically occur in motor vehicles is significantly increased by laser beam welding of this kind.

In this case, the laser beam welding was performed through the housing 40 which, as already explained further above, may be transparent in the green wavelength range. Accordingly, a green laser which can therefore pass through the housing 40 was used for the laser beam welding.

Figures 5A, 5B, 5C:
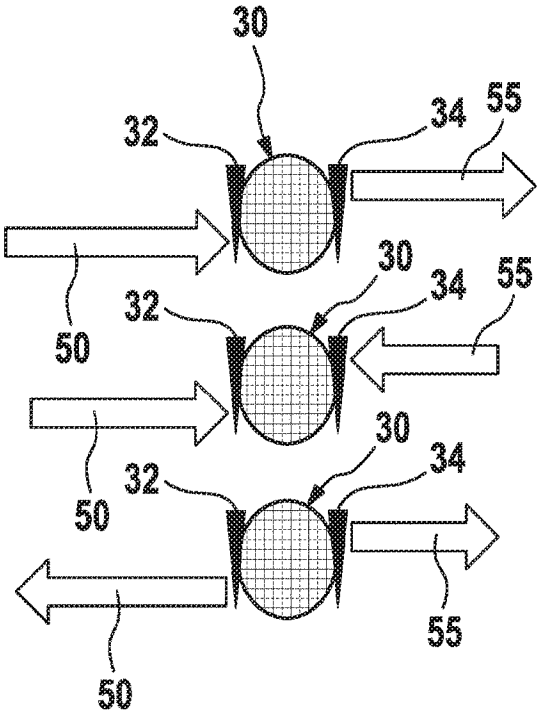
FIGS. 5*a*, 5*b* and 5*c* show effects of forces on the plug connection from FIG. 4.

FIGS. 5*a*, 5*b* and 5*c* show the loading situations already shown in FIGS. 3*a*, 3*b*, and 3*c* with a connecting zone 30 which has been strengthened by the welding points 32, 34. Reference is made to the above description of FIGS. 3*a*, 3*b*, and 3*c* in respect of the acting forces 50, 55. As is clearly apparent from FIGS. 5*a*, 5*b*, and 5*c*, the welding points 32, 34 increase the resistance of the connecting zone 30 to loads of this kind, this leading to a significantly longer service life overall.

The steps of the method as described herein may be executed in the indicated order. However, the steps can also be executed in a different order. In one of its embodiments, for example with a specific combination of steps, the method according to the invention can be executed in such a way that no further steps are executed. However, in principle, further steps can also be executed, even steps of a kind which have not been mentioned.

The claims that are part of the application do not represent any dispensing with the attainment of further protection.

If it turns out in the course of the process that a feature or a group of features is not absolutely necessary, then the applicant aspires right now to a wording for at least one independent claim that no longer has the feature or the group of features. This may be, by way of example, a subcombination of a claim present on the filing date or may be a subcombination of a claim present on the filing date that is limited by further features. Claims or combinations of features of this kind requiring rewording can be understood to be covered by the disclosure of this application as well.

It should further be pointed out that refinements, features and variants of the invention that are described in the various embodiments or exemplary embodiments and/or shown in the figures can be combined with one another in any desired manner. Single or multiple features can be interchanged with one another in any desired manner. Combinations of features arising therefrom can be understood to be covered by the disclosure of this application as well.

Back-references in dependent claims are not intended to be understood as dispensing with the attainment of independent substantive protection for the features of the back-referenced dependent claims. These features can also be combined with other features in any desired manner.

Features that are disclosed only in the description or features that are disclosed in the description or in a claim only in conjunction with other features may fundamentally be of independent significance essential to the invention. They can therefore also be individually included in claims for the purpose of distinction from the prior art.

The present invention has been described herein in an illustrative manner, and it is to be understood that the terminology which has been used is intended to be in the nature of words of description rather than of limitation. Obviously, many modifications and variations of the invention are possible in light of the above teachings. The invention may be practiced otherwise than as specifically described within the scope of the appended claims.

What is claimed is:

1. A method for establishing a plug connection, the method comprising:

combining a first terminal and a second terminal such that the first terminal and the second terminal overlap in a connecting zone;

sheathing the connecting zone with a plastic material which is transparent in at least one wavelength range; and irradiating the connecting zone with a laser beam after sheathing the connecting zone, the wavelength of said laser beam lying in the at least one wavelength range, for the purpose of carrying out laser beam welding.

2. The method as set forth in claim 1, wherein a welding point which connects the first terminal to the second terminal is formed by the laser beam welding.

3. The method as set forth in claim 1, wherein a plurality of welding points which connect the first terminal to the second terminal are formed by the laser beam welding.

4. The method as set forth in claim 1, wherein the first terminal is a male terminal.

5. The method as set forth in claim 4, wherein the second terminal is a female terminal.

6. The method as set forth in claim 1, wherein the first terminal and/or the second terminal has a flat tongue-like structure.

7. The method as set forth in claim 6, wherein the first terminal and/or the second terminal has a slide-on aid.

8. The method as set forth in claim 1, further comprising ascertaining an optimal focal point onto which the laser beam is then focused.

9. The method as set forth in claim 8 wherein the ascertaining an optimal focal point comprises ascertaining an optical focal point with an x-ray device.

10. The method as set forth in claim 2 further comprising checking the welding point which is formed.

11. The method as set forth in claim 10 wherein the checking the welding point comprises checking the welding point with an x-ray device.

12. The method as set forth in claim 1, wherein irradiating the connecting zone with a laser beam comprises irradiating the connecting zone with a laser beam from circumferential directions.

13. The method as set forth in claim 1, wherein irradiating the connecting zone with a laser beam comprises splitting the laser beam into a plurality of beam elements which are shone onto the connecting zone from different directions at the same time.

14. The method as set forth in claim 1, wherein the first terminal and/or the second terminal are formed from copper and/or bronze.

15. A method for strengthening a plug connection, wherein the plug connection is formed from a first terminal and a second terminal which overlap in a connecting zone, wherein the connecting zone is sheathed with a plastic material which is transparent in at least one wavelength range, wherein the method comprises:

irradiating the connecting zone with a laser beam, the wavelength of the laser beam lying in the at least one wavelength range, for the purpose of carrying out laser beam welding.

16. An apparatus having a plug connection, the apparatus comprising:

a first terminal and a second terminal combined such that the first terminal and the second terminal overlap in a connecting zone; and a plastic material sheathing the connecting zone, the plastic material being transparent in at least one wavelength range;

wherein the connecting zone and the plastic material are irradiated with a laser beam, the wavelength of said laser beam lying in the at least one wavelength range, for the purpose of carrying out laser beam welding.

* * * * *